US006224204B1

(12) United States Patent
Aoki

(10) Patent No.: US 6,224,204 B1
(45) **Date of Patent: *May 1, 2001**

(54) INK-JET PRINTING METHOD AND PRINT

(75) Inventor: Makoto Aoki, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/547,463

(22) Filed: Oct. 24, 1995

(30) Foreign Application Priority Data

Oct. 25, 1994 (JP) ..... 6-260059
Oct. 19, 1995 (JP) ..... 7-271352

(51) Int. Cl.[7] ..... B41J 2/01; B41J 3/407
(52) U.S. Cl. ..... 347/106; 347/101; 347/105
(58) Field of Search ..... 347/105, 106, 347/101

(56) References Cited

U.S. PATENT DOCUMENTS 4,902,568 * 2/1990 Morohoshi ..... 428/331
5,396,275 * 3/1995 Koike et al. ..... 347/101
5,494,733 * 2/1996 Koike et al. ..... 428/224
5,515,093 * 5/1996 Haruta et al. ..... 347/101

FOREIGN PATENT DOCUMENTS 0605730 7/1994 (EP) .
0613288 8/1994 (EP) .
4-59282 2/1992 (JP) .
5-212851 8/1993 (JP) .

* cited by examiner

*Primary Examiner*—John E. Barlow, Jr.
*Assistant Examiner*—An H. Do
(74) *Attorney, Agent, or Firm*—Fitzpatrick, Cella, Harper & Scinto

(57) ABSTRACT

Disclosed herein is an ink-jet printing method comprising ejecting inks by an ink-jet printing apparatus to conduct printing on a cloth, wherein a cloth having water absorption of at least 3 seconds as determined by a method (dropping method) prescribed by JIS L-1096 A is used as said cloth, a shot-in ink quantity per unit area of the cloth is changed to conduct gradation control, and a shot-in ink quantity per ink upon printing of the maximum color density is adjusted within a range of from not less than 8.0 $\mu g/mm^2$ to not more than 35.0 $\mu g/mm^2$.

6 Claims, 4 Drawing Sheets

133
130
1

1000
1100, 1120
1010
1022
1012
1030
1032
1020
1100
140
140
150
15
110
100
130
120
1B
f
17
19
600
21
13
1
11

INK-JET PRINTING METHOD AND PRINT

BACKGROUND OF THE INVENTION

1. Field of the Invention

The present invention relates to an ink-jet printing method by which a print with excellent gradation can be provided.

2. Related Background Art

Besides screen printing and roller printing, ink-jet printing has been used as a process for conducting printing on cloth. The ink-jet printing is a plateless system in which neither a screen nor an engraved roller is required, and is hence fit for multi-kind small-quantity production. The techniques required of this ink-jet printing are greatly different from those of screen or roller printing. This is caused by differences in the systems such as the optimum value of viscosity among physical properties of inks used in ink-jet printing is greatly different from that of textile printing inks used in screen printing or the like and is considerably lower, the ink-jet printing requires attention to reliability such as preventing clogging of the head, the so-called additive color process, in which a few inks of different colors are shot on the same position so as to overlap each other, is conducted; and dots of the inks are very small.

Various investigations have thus been attempted as to methods of such ink-jet printing, in particular, from the viewpoint of improvement in coloring ability, prevention of bleeding, and/or the like. With respect to cloths used in such a method, for example, Japanese Patent Application Laid-Open No. 4-59282 discloses an ink-jet printing cloth formed of a hydrophilic fiber material containing 0.1 to 3% by weight of a surfactant. In the case of a cloth subjected to such a treatment, inks are absorbed in the interior of the fiber by diffusion, and so the travelling distance of the inks is comparatively short, and sharp bleeding is hence prevented to some extent. However, such a cloth is unfavorable to improvement in coloring ability because dyes penetrate into the interior of the fiber. Even if the shot-in ink quantity of an ink is increased with a view toward heightening color density, the ink is only absorbed in the interior of the cloth, and the color density on the surface of the cloth cannot be made high.

Even in the case where no surfactant is used, as with the above, the ink is absorbed in the interior of the cloth unless a substance for lengthening the time required to absorb water is applied to the cloth, and the color density on the surface of the cloth cannot be made high.

As described above, the prior art techniques have been able to satisfy individual performance characteristics required of the ink-jet printing process for obtaining excellent prints to some extent, but have been unable to satisfy all the performance characteristics at the same time.

SUMMARY OF THE INVENTION

It is therefore an object of the present invention to provide an ink-jet printing method, which can provide bright prints free of bleeding, high in color depth, excellent in gradation and high in image quality and grade, and prints excellent in properties obtained by such an ink-jet printing method.

The above object can be achieved by the present invention described below.

According to the present invention, there is thus provided an ink-jet printing method comprising ejecting inks by an ink-jet printing apparatus to conduct printing on a cloth, wherein a cloth having water absorption of at least 3 seconds as determined by a method (dropping method) prescribed by JIS L-1096 A is used as said cloth, the shot-in ink quantity per unit area of the cloth is changed to conduct gradation control, and the shot-in ink quantity per ink upon printing of the maximum color density is controlled within a range of from not less than 8.0 $\mu g/mm^2$ to not more than 35.0 $\mu g/mm^2$.

According to the present invention, there is also provided a print obtained by the method described above.

DESCRIPTION OF THE PREFERRED EMBODIMENTS

Figures 1A, 1B:
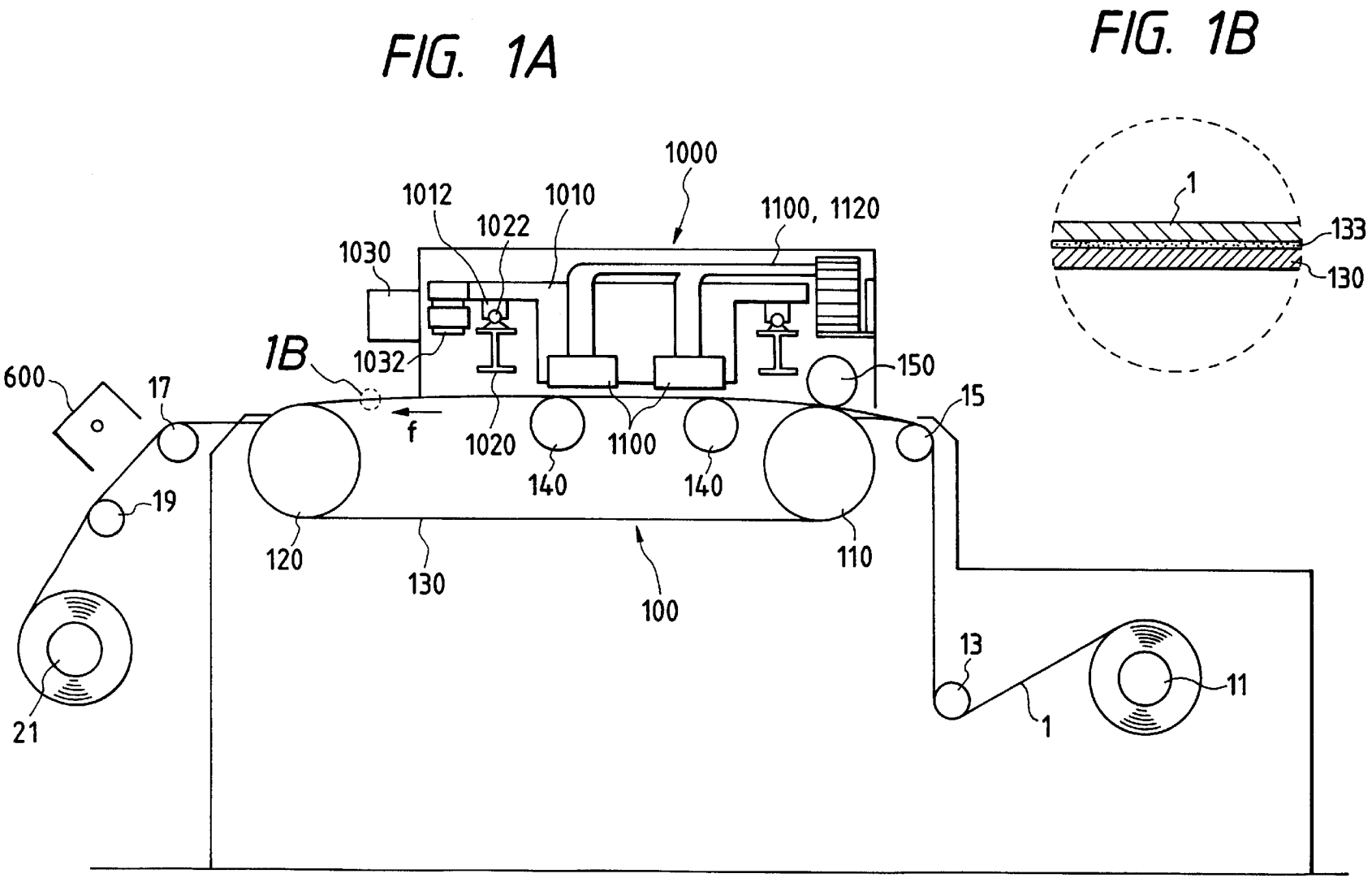
FIG. 1A is a typical sectional side elevation schematically illustrating the constitution of an ink-jet printing apparatus to which the present invention is applied.
FIG. 1B is an enlarged view of a portion of a conveyor belt in FIG. 1A.

According to the ink-jet printing method based on the present invention, textile printing can be performed with excellent gradation in addition to excellent coloring ability and resistance to bleeding.

Although the above-described method of the prior art technique that "a surfactant is contained in fiber to absorb inks in the interior of the fiber by diffusion" can improve sharp bleeding to some extent, it does not achieve effective absorption of light by dyes because the dyes penetrate into the interior of the fiber, and hence can provide only a print poor in coloring ability.

To the contrary, according to the method of the present invention, inks are not absorbed in the interior of the fiber, but are liable to remain on the surface of the fiber because the cloth having water asorption of at least 3 seconds, i.e., good water repellency, is used. In addition, since a shot-in ink quantity per ink upon printing of the maximum color density is controlled to at least 8.0 $\mu g/mm^2$, inks are shot out in a quantity sufficient to fill up a solid area. It is therefore considered that coloring ability is much improved.

On the other hand, when a shot-in ink quantity is lessened upon expressing low color depth, the spread of dots is also lessened because the cloth used in the technique of the present invention is hard to absorb ink, so that an area factor (a proportion of dots occupied in a unit area) is lowered, and a blank area hence becomes greater. Therefore, a color density becomes low, thereby achieving excellent reproducibility in low color density.

Even if a shot-in ink quantity is lessened to express low color depth in the cloth of the type that inks are absorbed in the interior of the fiber, the area factor is not lowered because of wide spread of dots, and a blank area hence becomes lessened, resulting in poor reproducibility in low color density.

Accordingly, in the present invention, gradation expressibility from low color density area to high color density area is excellent, whereas both gradation and coloring ability are poor in the prior art techniques.

The present invention will now be described in more detail by preferred embodiments.

No particular limitation is imposed on the fiber material for the ink-jet printing cloth used in the present invention. Examples thereof include various fiber materials such as cotton, silk, wool, nylon, polyester, rayon and acrylic fibers. The cloth used may be a blended fabric or union cloth thereof.

The water absorption, which is an important factor in the present invention, was determined by measuring the water absorption time using, as a measuring means, a method (dropping method) prescribed by JIS L-1096 A.

This method is performed as follows. Ten test pieces of approximately 20×20 cm are attached to a metal ring (having a diameter of 15 cm). Next, by using a buret capable of dividing 1 ml of water in 25±3 droplets, a droplet of water is dropped from the forward end of the buret, which is at a height of 1 cm from the test piece surface, and the period of time (second) that elapses between the moment the droplet reaches the test piece and the moment the droplet ceases to give special reflection is measured by a stop watch. The test is conducted ten times, and the average value (s) is obtained (to the first decimal place).

The water used is one as defined in JIS K 0050 (General rule for Chemical Analysis Method). The temperature of the water is 20±2° C.

When the test piece has a high water absorption degree, it is also possible to use a 50 or 65% sugared water in place of water. In this case, the calibration value is 0.141 for 50%, and 0.023 for 65%.

The term "the droplet ceases to give special reflection" designates a state when a mirror reflection disappears as the test piece absorbs the droplets, leaving only a moisture.

The ring to which the test piece is attached is placed between the light source and the observer, the observation being performed from an angle which gives a clearer view of the special reflection of the droplet.

The shorter the average moistening time, the more easily is the test piece to become wet.

Various methods are considered as a method of controlling the absorption of ink into cloth, i.e., penetrability.

As a method of controlling the penetration of the ink into the cloth, there is a method in which an antipenetrant is contained in fiber. In this case, the antipenetrant means a substance which lowers the permeability of a cloth when added in a certain amount to the cloth as compared with the cloth before its addition. As specific examples of the method for containing the antipenetrant, there are considered various methods such as a method in which a softening water repellent or a water repellent is contained, a method in which a cationic substance is contained, a method in which interstices among fibers are filled in by oil, fat, wax, pigment, rubber, plastic or the like. Any of these methods may be used. However, the method making use of the softening water repellent or the water repellent is particularly preferred.

As a method of containing the above-described antipenetrant in the cloth, any method such as padding, spraying, dipping, printing or ink-jet may be used.

The above method will be described in more detail.

The softening water repellent or the water repellent used for controlling the penetration of ink has the ability to repel water which is a main component of ink. Examples thereof include fluorine-containing compounds, paraffinic compounds, pyridinium salts, N-methylolalkylamides, alkylethyleneureas, oxazoline derivatives, silicone compounds, triazine compounds, polyamide amine type softening agent paraffins, zirconium compounds and mixtures thereof, to which, however, is not limited. Of these, fluorine-containing compounds and paraffinic compounds are particularly preferred.

The water repellent is applied in an amount of from 0.1 to 10% by weight to a cloth so as to control the water absorption time of the cloth to at least 3 seconds, preferably within a range of from 10 seconds to 200 seconds. If the water absorption time is shorter than 3 seconds, the effect of controlling the penetration of ink becomes insufficient. When a cloth having water absorption of at least 3 seconds is used, inks are not absorbed in the interior of the fiber, but tend to remain on the surface of the fiber, and so the color density on the surface becomes high. Besides, when the water absorption is controlled to at most 200 seconds, the inks moderately penetrate the interior of the fiber, and so excellent drying ability can be achieved.

Examples of the cationic substance used for controlling the penetration of ink include various amine salts, quaternary ammonium salt type cationic surfactants, quaternary ammonium salt polymers and polyamines.

The cationic substance is applied in an amount of from 0.1 to 10% by weight to a cloth so as to control the water absorption time of the cloth to at least 3 seconds, preferably within a range of from 10 seconds to 200 seconds.

Specific examples of the oil, fat, wax, pigment, rubber and plastic used for controlling the penetration of ink include mineral oils, fatty acids, paraffin wax, silica powder, diatomaceous earth, natural rubber, olefin polymers and acrylic polymers. Such an agent is applied in an amount of from 0.1 to 10% by weight to a cloth so as to control the water absorption time of the cloth to at least 3 seconds, preferably within a range of from 10 seconds to 200 seconds.

The cloth according to the present invention contains the above-described substances for the purpose of controlling its water absorption, but may also contain compounds other than these substances. Examples of compounds, which may be added to the cloth of the present invention, include catalysts, alkalis, acids, antireductants, antioxidants, level dyeing agents, deep dyeing agents, carriers, reducing agents, oxidizing agents and metal ions.

After conducting the treatment in which the antipenetrant as described above is applied to a cloth, the thus-treated cloth is finally dried and optionally cut into sizes conveyable in an ink-jet apparatus, thereby providing these cut pieces as ink-jet printing cloths.

No particular limitation is imposed on textile printing inks used for the ink-jet printing cloths in the present invention. However, when the cloth is formed of a material such as cotton or silk, ink-jet textile printing inks composed of a reactive dye and an aqueous medium are preferably used. When the cloth is formed of a material such as nylon, wool, silk or rayon, ink-jet textile printing inks composed of an acid or direct dye and an aqueous medium are preferably used. Besides, when the cloth is formed of a polyester material, ink-jet textile printing inks composed of a disperse dye and an aqueous medium are preferably used.

As specific preferable examples of these dyes, the following dyes may be mentioned. The reactive dyes include C.I. Reactive Yellow 2, 15, 37, 42, 76, 95, 168 and 175; C.I. Reactive Red 21, 22, 24, 33, 45, 111, 112, 114, 180, 218, 226, 228 and 235; C.I. Reactive Blue 15, 19, 21, 38, 49, 72, 77, 176, 203, 220, 230 and 235; C.I. Reactive Orange 5, 12, 13, 35 and 95; C.I. Reactive Brown 7, 11, 33, 37 and 46; C.I. Reactive Green 8 and 19; C.I. Reactive Violet 2, 6 and 22; C.I. Reactive Black 5, 8, 31 and 39; and the like.

The acid and direct dyes include C.I. Acid Yellow 1, 7, 11, 17, 23, 25, 36, 38, 49, 72, 110 and 127; C.I. Acid Red 1, 27, 35, 37, 57, 114, 138, 254, 257 and 274; C.I. Acid Blue 7, 9, 62, 83, 90, 112 and 185; C.I. Acid Black 26, 107, 109 and 155; C.I. Acid Orange 56, 67 and 149; C.I. Direct Yellow 12, 44, 50, 86, 106 and 142; C.I. Direct Red 79 and 80; C.I. Direct Blue 86, 106, 189 and 199; C.I. Direct Black 17, 19, 22, 51, 154, 168 and 173; C.I. Direct Orange 26 and 39; and the like.

The disperse dyes include C.I. Disperse Yellow 3, 5, 7, 33, 42, 60, 64, 79, 104, 160, 163 and 237; C.I. Disperse Red 1, 60, 135, 145, 146 and 191; C.I. Disperse Blue 56, 60, 73, 143, 158, 198, 354, 365 and 366; C.I. Disperse Black 1 and 10; C.I. Disperse Orange 30 and 73; Teraprint Red 3GN Liquid and Teraprint Black 2R; and the like.

The amount (in terms of solids) of these dyes to be used is preferably within a range of from 1 to 30% by weight based on the total weight of the ink.

As water-soluble solvents used together with the dyes, those generally used in ink-jet printing inks may be used. Preferable examples thereof include lower alkylene glycols such as ethylene glycol, diethylene glycol, triethylene glycol and propylene glycol; lower alkyl ethers of alkylene glycols, such as ethylene glycol methyl (ethyl, propyl or butyl) ether, diethylene glycol methyl (ethyl, propyl or butyl) ether, triethylene glycol methyl (ethyl, propyl or butyl) ether, propylene glycol methyl (ethyl, propyl or butyl) ether, dipropylene glycol methyl (ethyl, propyl or butyl) ether and tripropylene glycol methyl (ethyl, propyl or butyl) ether; polyalkylene glycols such as polyethylene glycol and polypropylene glycol and products obtained by modifying one or two hydroxyl groups thereof, typified by mono- or dialkyl ethers thereof; glycerol; thiodiglycol; sulfolane; N-methyl-2-pyrrolidone; 2-pyrrolidone; and 1,3-dimethyl-2-imidazolidinone. The preferable content of these water-soluble solvents is generally within a range of from 0 to 50% by weight based on the total weight of the ink.

In the case of a water-based ink, the content of water as a principal component is preferably within a range of from 30 to 95% by weight based on the total weight of the ink.

Besides the above components, anti-clogging agents such as urea and derivatives thereof, dispersants, surfactants, viscosity modifiers such as polyvinyl alcohol, cellulosic compounds and sodium alginate, pH adjustors, optical whitening agents, mildewproofing agents, and the like may be added as other ingredients for inks as needed.

As an ink-jet recording method and apparatus used, there may be used any method and apparatus conventionally known. Examples thereof include a method and an apparatus in which thermal energy corresponding to recording signals is applied to an ink within a recording head, and ink droplets are generated by this thermal energy.

With respect to the method for expressing gradation, a method of controlling the diameter of a dot as a multi-valued technique may be used, and a dither method or an error diffusion method as a two-valued technique may be used. These methods have individual features, but each permits the expression of halftone by changing a shot-in ink quantity (weight) per unit area.

Figure 5:
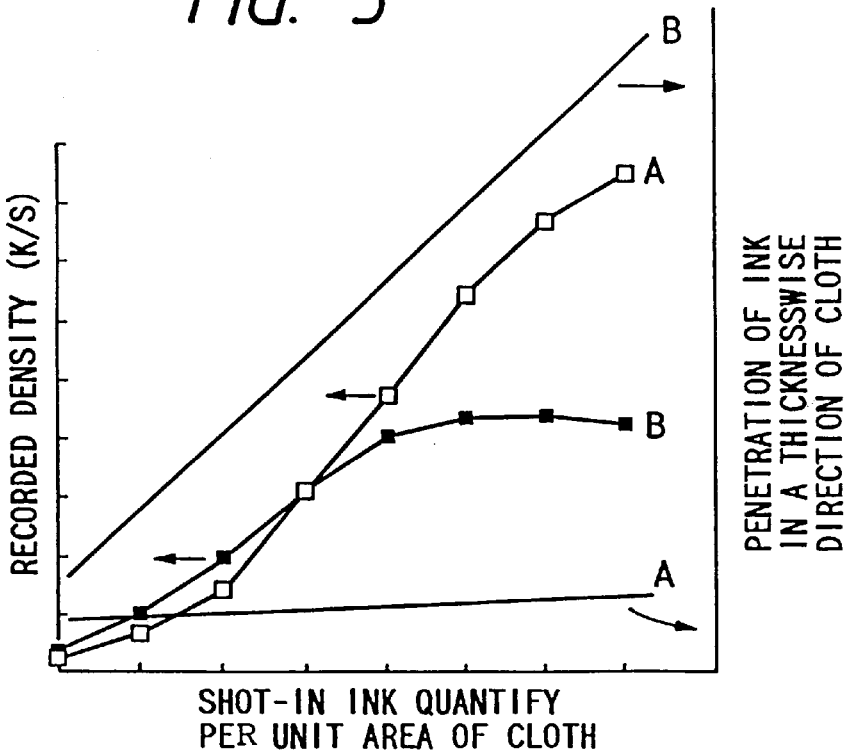
FIG. 5 is a graph illustrating a comparison between gradation and penetration of ink in a cloth.

In FIG. 5, there is shown recorded densities (K/S) obtained by using a cloth (A) the water absorption of which is at least 3 seconds as determined by the method of JIS L-1096 A and changing a shot-in ink quantity per unit area of the cloth in accordance with the dither method. For the sake of comparison, recorded densities as to a cloth (B) the water absorption of which is 1 second are also shown.

In the cloth A, the recorded density increases in substantial proportion to the shot-in ink quantity per unit area of the cloth. Therefore, excellent gradation is achieved from low color density to high color density. On the other hand, in the cloth B, the recorded density ceases to increase after the shot-in ink quantity reaches a certain amount or more. This is attributable to the fact that since the cloth B is permeable as demonstrated by the water absorption of 1 second, the ink penetrates farther into the thickness of the cloth as the shot-in ink quantity increases, and so coloring cannot be effectively conducted, whereas the cloth A is hydrophobic as demonstrated by the water absorption of at least 3 seconds, and so the ink does not penetrate very far into the thickness the cloth, but remains on the surface of the cloth, whereby excellent coloring effect can be achieved.

A shot-in ink quantity upon printing of the maximum color density is preferably not less than 8.0 $\mu g/mm^2$ but not more than 35.0 $\mu g/mm^2$ per ink. If the shot-in ink quantity is not less than 8.0 $\mu g/mm^2$, an area of a cloth to be printed can be substantially filled in with ink droplets, and so high color density can be achieved. On the other hand, if the shot-in ink quantity is not more than 35.0 $\mu g/mm^2$, the ink is sufficiently absorbed without running, and so no bleeding occurs. The shot-in ink quantity is most preferably within a range of from 10.0 $\mu g/mm^2$ to 20.0 $\mu g/mm^2$.

The inks applied onto the ink-jet printing cloth in accordance with the method of the present invention in the above-described manner only adhere to the cloth in this state. Accordingly, it is preferable to subsequently subject the cloth to a process for fixing the dyes in the inks to the fibers and a process for removing unfixed dyes. Such a fixing process may be conducted in accordance with any conventionally-known method. Examples thereof include a steaming process, an HT steaming process and a thermofix process. The removal of the unfixed dyes may be performed by any washing process conventionally known.

After conducting the ink-jet printing and the post-treatment of the cloth in the above-described manner, the cloth is dried to provide a print according to the present invention.

An exemplary constitution of an ink-jet printing apparatus used in the present invention will hereinafter be roughly described. It goes without saying that the apparatus to which the present invention can be applied is not limited to the construction as described below. It is therefore possible to make any change in construction and add any structural element, which are easily conceived by those skilled in the art.

FIG. 1A is a typical sectional side elevation schematically illustrating the construction of a printing apparatus. Reference numeral 1 designates a cloth as a printing medium. The cloth 1 is unwound according to the rotation of a rewind roller 11, conveyed in a substantially horizontal direction by a conveyance section 100, which is provided at a position opposite to a printer section 1000, through intermediate rollers 13 and 15, and then wound up on a take-up roller 21 through a feed roller 17 and an intermediate roller 19.

The conveyance section 100 roughly includes conveyance rollers 110 and 120 respectively provided on the upstream and downstream sides of the printer section 1000 viewing from the feeding direction of the cloth 1, a conveyor belt 130 in the form of an endless belt, which is extended between and around these rollers, and a pair of platen rollers 140 provided so as to extend the conveyor belt 130 under an appropriate tension in a predetermined range to enhance its evenness, thereby evenly regulating the surface of the cloth 1 to be printed by the printer section 1000. In the illustrated apparatus, the conveyor belt 130 is made of a metal as disclosed in Japanese Patent Application Laid-Open No. 5-212851. As illustrated in FIG. 1B with partial enlargement, an adhesive layer (sheet) 133 is provided on its surface. The cloth 1 is adhered to the conveyor belt 130 through the adhesive layer 133 by an attaching roller 150, thereby ensuring the evenness of the cloth 1 upon printing.

To the cloth 1, conveyed in a state such that the evenness has been ensured as described above, is applied a printing agent in the region between the platen rollers 140 by the printer section 1000. The thus-printed cloth 1 is separated from the conveyor belt 130, or the adhesive layer 133 at the position of the conveyance roller 120 and wound up on the take-up roller 21. In the course of the winding, the cloth is subjected to a drying treatment by a drying heater 600. In particular, this drying heater 600 is effective when a liquid agent is used as the printing agent. The form of the drying heater 600 may be suitably selected from a heater by which hot air is blown on the cloth 1, a heater by which infrared rays are applied to the cloth 1, and the like.

Figure 2:
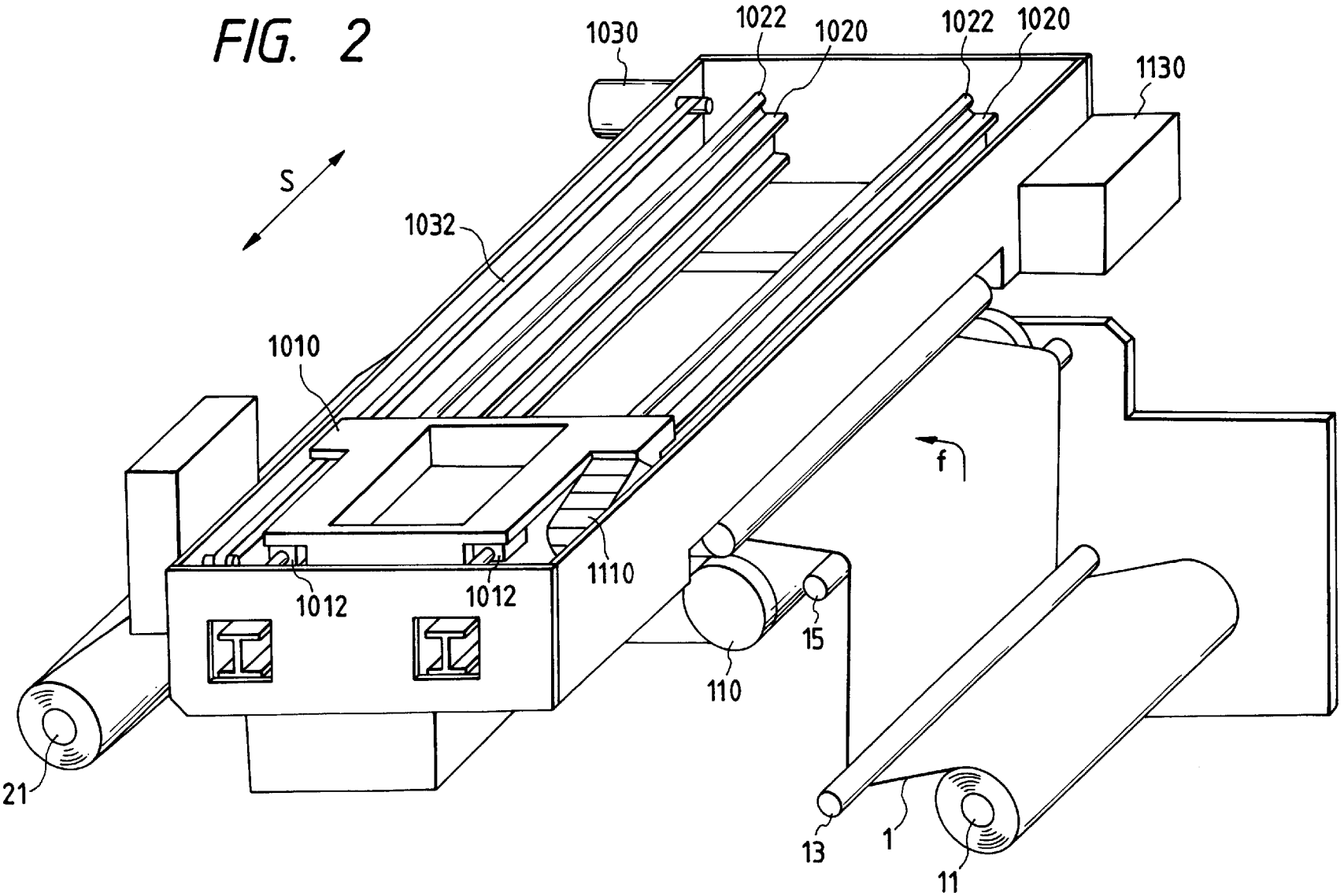
FIG. 2 is a perspective view typically illustrating a printer section and a conveyance section in the apparatus shown in FIG. 1A.

FIG. 2 is a perspective view typically illustrating the printer section 1000 and the conveyance system of the cloth 1. The constitution of the printer section 1000 will be described with reference to this drawing and FIG. 1A.

In FIGS. 1A and 2, the printer section 1000 includes a carriage 1010 which scans in a direction different from the conveying direction (a secondary scanning direction) f of the cloth 1, for example, the width direction S of the cloth 1 perpendicular to the conveying direction f. Reference numeral 1020 designates a support rail extending in the S direction (a main scanning direction) and supporting a slide rail 1022 which supports and guides a slider 1012 fixed to the carriage 1010. Reference numeral 1030 indicates a motor as a drive source for conducting the main scanning of the carriage 1010. The driving power thereof is transmitted to the carriage 1010 through a belt 1032 to which the carriage 1010 has been fixed, or another suitable drive mechanism.

On the carriage 1010, are mounted sets of printing heads 1100 each having many printing agent-applying elements arranged in a predetermined direction (in this case, the conveying direction f), said sets each being composed of a plurality of the printing heads 1100 arranged in a direction (in this case, the main scanning direction S) different from said predetermined direction. In this embodiment, two sets of the printing heads 1100 are held in the conveying direction. In each set, the printing heads 1100 are provided in a number corresponding to the number of printing agents of different colors, thereby permitting color printing. Colors of the printing agents and the number of the printing heads in each set may be suitably selected according to an image intended to be formed on the cloth 1, and the like. For example, yellow (Y), magenta (M) and cyan (C), or the three primary colors for printing, or black (Bk) in addition to these colors may make one set. Alternatively, special colors (metallic colors such as gold and silver, and bright red, blue, etc.), which are impossible or difficult to be expressed by the three primary colors, may be used in place of or in addition to the above color set. Further, a plurality of printing agents may be used according to their color density even if they have the same colors as each other.

In this embodiment, as illustrated in FIG. 1A, two sets of the printing heads 1100, which each are composed of plural printing heads arranged in the main scanning direction S, are provided one by one in the conveying direction f. The colors, arranging number, arranging order and the like of the printing agents used in the printing heads in the respective sets may be the same or different from each other according to the image intended to be printed, and the like. Further, printing may be made again by the printing heads of the second set on a region printed by main scanning of the printing heads of the first set (either complementary thinning-out printing or overlap printing may be conducted by the respective sets of the printing heads). Furthermore, a printing region may be allotted to each set to perform high-speed printing. Besides, the number of sets of the printing heads is not limited to two and may also be defined as one or more than two.

In these drawings, ink-jet heads, for example, bubble jet heads proposed by Canon Inc., each having a heating element which generates thermal energy causing film boiling of ink as energy used for ejecting the ink, are used as the printing heads 1100. Each of the printing heads is used in a state that ink ejection orifices as the printing agent-applying elements have been disposed downward toward the cloth 1 substantially horizontally conveyed by the conveyance section 100, thereby ironing out the difference in water head between the individual ejection orifices and hence making ejection conditions uniform to permit both formation of good images and even purging operation for all the ejection orifices.

A flexible cable 1110 is connected to each of the printing heads 1100 in such a manner that it follows the movement of the carriage 1010, so that various signals such as drive signals and state signals for the head are transferred between the head and control means not illustrated. Inks are fed from an ink-feeding system 1130, in which respective inks of different colors are contained, to the printing heads 1100 through flexible tubes 1120.

Figure 3:
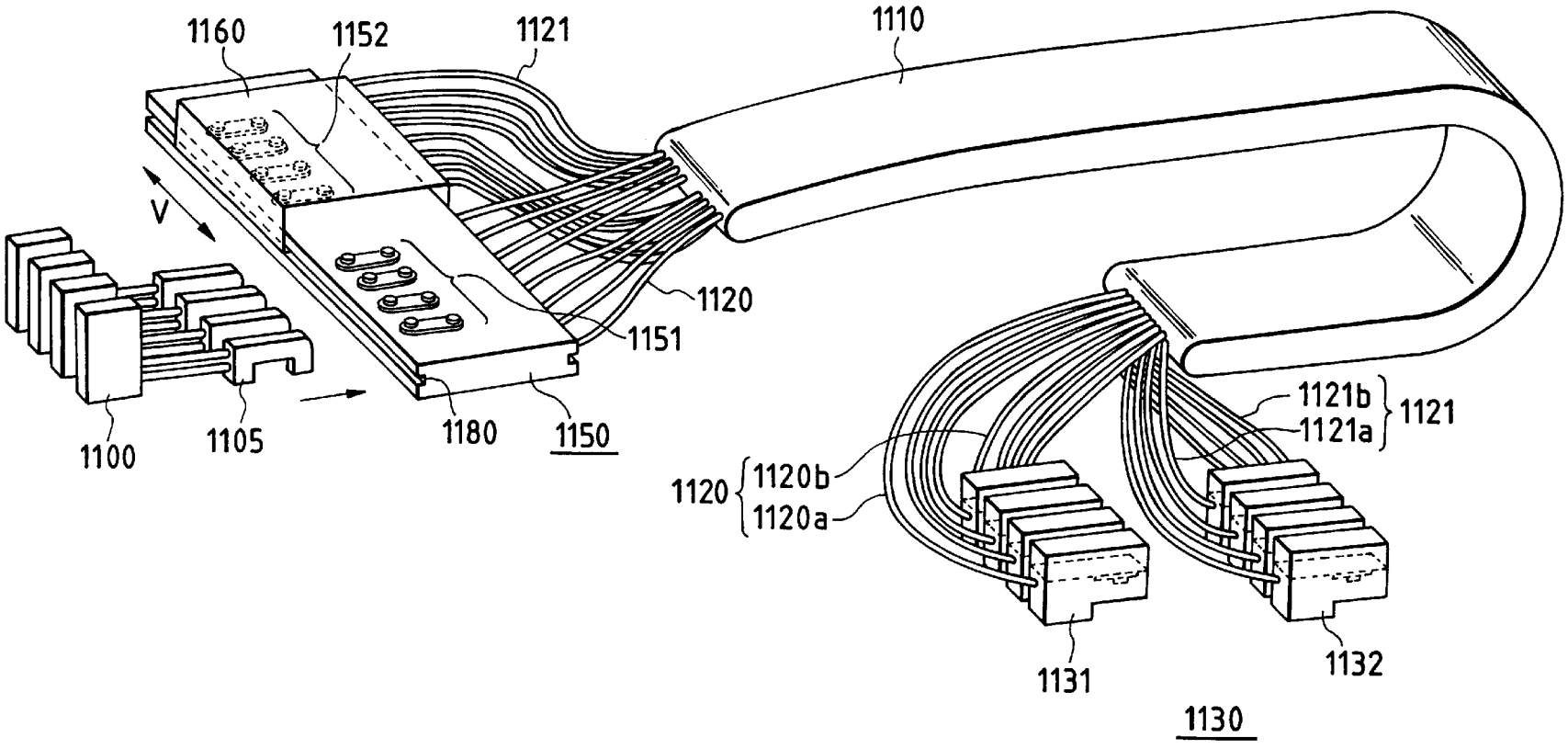
FIG. 3 is a typical perspective view of an ink-feeding system in the apparatus shown in FIG. 1A.

FIG. 3 is a perspective view typically illustrating the ink-feeding system in this embodiment. The ink-feeding system 1130 is composed of two lines. More specifically, in the first line, first ink-feeding tubes 1120 respectively connected to the first set of ink-storage tanks 1131 are connected to a head joint 1150 through the flexible tube 1110. In the second line, similarly, second ink-feeding tubes 1121 respectively connected to the second set of ink-storage tanks 1132 are connected to the head joint 1150 through the flexible tube 1110.

Each ink-feeding tube 1120 or 1121 forms a circulation path composed of an outward ink-feeding tube 1120*a* or 1121*a* and an inward ink-feeding tube 1120*b* or 1121*b*.

The ink-storage tanks 1131 and 1132 each have a pressure pump (not illustrated). The ink in the tank 1131 or 1132 is pressurized by this pressure pump so as to pass through the outward ink-feeding tube 1120*a* or 1121*a* and ink connecter 1105 as illustrated in FIG. 3, circulate through the printing head 1100 and then pass through the inward ink-feeding tube 1120*b* or 1121*b*, thereby returning to the ink-storage tank 1131 or 1132.

By this pressure pump, it is possible to recharge the inks into the ink-feeding tubes 1120 and 1121 and also to conduct a purging operation of the head by circulating the ink through the head and discharging a fraction of this ink out of nozzles in the head. The ink-storage tanks 1131 and 1132 may be provided respectively by a number corresponding to the number of the printing agents of different colors, thereby permitting color printing.

The number of the ink-storage tanks in each set may be suitably selected according to an image intended to be formed on the cloth 1, and the like. For example, three tanks for yellow (Y), magenta (M) and cyan (C) colors, or the three primary colors for printing, or four tanks with a tank for a black (Bk) color added to these tanks may be provided. Alternatively, tanks for special colors (metallic colors such as gold and silver, and bright red, blue, etc.), which are impossible or difficult to be expressed by the three primary colors, may be used in place of or in addition to the above tanks. Further, a plurality of tanks may be used according to the color density even if printing agents used have the same colors as each other.

The head joint 1150 is composed of a head joint 1151 for the first set indicated by a full line in FIG. 3, a head joint 1152 for the second set indicated by a broken line in FIG. 3 and a joint cover 1160.

The constitution of the head used in the above-described apparatus will hereinafter be described schematically with reference to FIG. 4.

Figure 4:
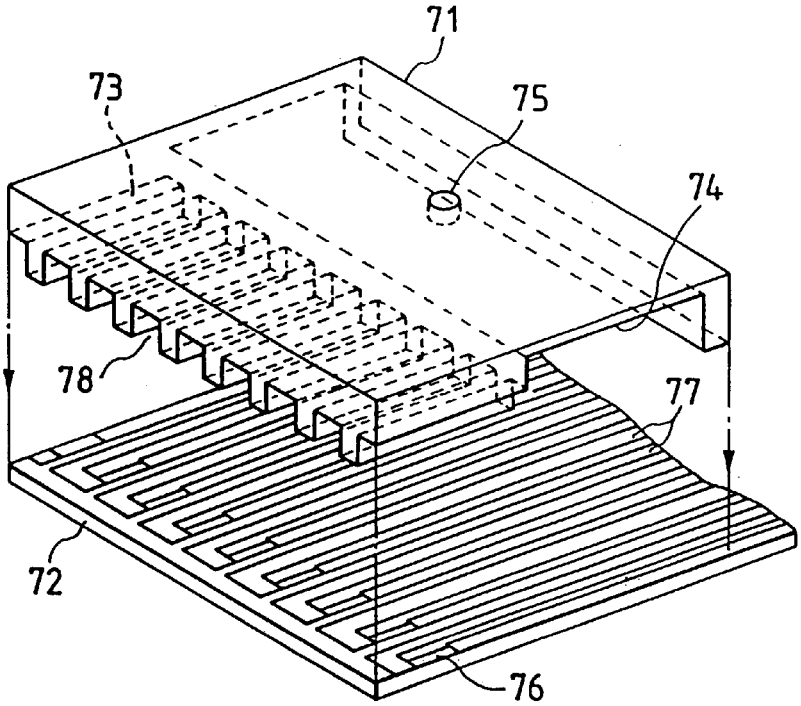
FIG. 4 is a perspective view schematically illustrating the constitution of a printing head to be mounted on the apparatus shown in FIG. 1A.

FIG. 4 is a sectional perspective view schematically illustrating the construction of an ink-jet head to be mounted on the ink-jet printing apparatus used in the present invention.

In this drawing, the printing head is constructed by overlapping a top plate 71 and a base plate 72. The top plate 71 has a plurality of grooves 73, which are to define nozzles passing an ink therethrough, a groove 74, which is to define a common liquid chamber communicating with these grooves, and a feed opening 75 for feeding the ink to the common liquid chamber. On the other hand, the base plate 72 includes electrothermal converters 76 corresponding to the individual nozzles and electrodes 77 for supplying electric power to the electrothermal converters 76, respectively, said electrothermal converters and electrodes being formed integrally by a film-forming technique. Ejection openings (orifices) 78 through which the ink is ejected are defined by overlapping the top plate 71 and the base plate 72 as described above.

Here, the process of forming ink droplets by the bubble jet system, which is carried out by the above-described printing head, will be described simply.

When a heating resistor (heater) reaches a predetermined temperature, such a filmy bubble as covers a heater surface is first formed. The internal pressure of this bubble is very high, and so an ink within a nozzle is forced out. The ink is moved toward the outside of the nozzle and the interior of the common liquid chamber by inertia due to this forcing out. When the movement of the ink is facilitated, the moving speed of the ink within the nozzle becomes slow because the internal pressure of the bubble becomes negative pressure, and flow path resistance also arises. Since the ink portion ejected out of the ejection opening (orifice) is faster in moving speed than the ink within the nozzle, it is constricted by the balance among inertia, flow path resistance, shrinkage of the bubble and surface tension of the ink, whereby the ink portion is separated into a droplet. At the same time as the shrinkage of the bubble, the ink is fed to the nozzle from the common liquid chamber by capillary force to wait for the next pulse.

As described above, the printing head (which hereinafter may be referred to as an ink-jet head), in which the electrothermal converter is used as an energy-generating means (which hereinafter may be referred to as an energy-generating element), can generate a bubble in the ink within the flow path in one-to-one correspondence in accordance with a driving electrical pulse signal and also immediately and appropriately cause the growth/shrinkage of the bubble, and so the ejection of ink droplets can be achieved with excellent responsiveness in particular. The printing head is advantageous in that it can also be made compact with ease, merits of IC techniques and macro processing techniques in the recent semiconductor field, which are remarkable for advances in technique and enhancement in reliability, can be fully applied thereto, high-density mounting can be achieved with ease, and production costs are also low.

The present invention will hereinafter be described more specifically by the following examples and comparative examples. Incidentally, all designations of "part" or "parts" and "%" as will be used in the following examples mean part or parts by weight and % by weight unless expressly noted.

EXAMPLES 1 to 13

(A) Production of ink-jet Printing Cloth

A 100% cotton satin fabric (mercerized product), a 100% nylon taffeta fabric and a 100% polyester tropical fabric were separately subjected to a pretreatment with their corresponding pretreatment agents shown in Table 1 by the padding process. The thus-pretreated fabrics were then squeezed to a pickup of 70% by a mangle and dried at a drying temperature of 120° C. for 2 minutes.

(B) Preparation of ink-jet Printing Ink

Reactive dye inks, acid dye inks and disperse dye inks were prepared in the following manner. The total amounts of the inks are all 100 parts.

| (1) Reactive dye inks: | |
|---|---|
| Reactive dye | 10 parts |
| Thiodiglycol | 40 parts |
| Water | 50 parts. |

Dyes used were C.I. Reactive Yellow 95, C.I. Reactive Red 226, C.I. Reactive Blue 15 and C.I. Reactive Black 39.

| (2) Acid dye inks: | |
|---|---|
| Acid dye | 10 parts |
| Diethylene glycol | 40 parts |
| Water | 50 parts. |

Dyes used were C.I. Acid Yellow 110, C.I. Acid Red 266, C.I. Acid Blue 90 and C.I. Acid Black 26.

| (3) Disperse dye inks: | |
|---|---|
| Disperse dye | 10 parts |
| Thiodiglycol | 40 parts |
| Water | 50 parts. |

Dyes used were C.I. Disperse Yellow 42, Teraprint Red 3GN Liquid (trade name, a disperse dye produced by Ciba-Geigy AG) and Teraprint Black 2R (trade name, a disperse dye produced by Ciba-Geigy AG). These disperse dye inks each contained a dispersant for dispersing the dye.

(C) Ink-jet Printing

Using a Bubble Jet Printer BJC-820J (manufactured by Canon Inc.), in which heads each ejecting 84 ng of ink were mounted, as an ink-jet printing apparatus, sets of the above-prepared printing inks were separately charged in this printer. The fabrics were separately mounted on base paper webs to permit the conveying of the fabrics, thereby conducting printing (the maximum shot-in ink quantity per ink: 17 $\mu g/mm^2$). Any printing apparatus may be used, without limitation, as the above printing apparatus.

Each 20×20 mm square pattern was printed with the shot-in ink quantity per unit area of the fabric varied in the order of 2, 8 and 17 $\mu g/mm^2$ according to the dither method.

(D) Post-treatment

The printed fabrics were subjected to a steaming treatment at 100° C. for 8 minutes for the reactive dye inks, at 100° C. for 30 minutes for the acid dye inks, or at 180° C. for 10 minutes for the disperse dye inks. The thus-treated fabrics were washed and then dried.

(E) Evaluation of Prints

The thus-obtained print samples were evaluated in the following manner. The results are shown in Table 1.

(1) Bleeding:

The linearity of fine-line portions in each print sample was visually observed to rank resistance to bleeding in accordance with the following standard:

A: Good;

B: Somewhat poor;

C: Poor.

(2) Maximum color density (K/S):

Minimum spectral reflectances of printed areas of the 20×20 mm square pattern in each print sample were measured by a Minolta Spectrocolorimeter CM-2022 (trade name). Respective K/S values were found from these reflectances. The maximum color density was ranked in terms of the K/S values in shot-in ink quantities per unit area of 8 and 17 $\mu g/mm^2$ in accordance with the following standard:

A: At least 15;

C: Smaller than 15.

(3) Gradation:

Minimum spectral reflectances of printed areas of the 20 20 mm square pattern in each print sample were measured by the Minolta Spectrocolorimeter CM-2022. Respective K/S values were found from these reflectances. The gradation was ranked in terms of ratios of the K/S value in the shot-in ink quantity per unit area of 8 $\mu g/mm^2$ to the K/S value in 2 $\mu g/mm^2$ and of the K/S value in the shot-in ink quantity per unit area of 17 $\mu g/mm^2$ to the K/S value in 2 $\mu g/mm^2$ in accordance with the following standard:

A: At least 8;

C: Smaller than 8.

COMPARATIVE EXAMPLES 1 TO 15

Ink-jet printing and evaluation were conducted in the same manner as in Examples 1 to 13 except that the cloths, the pretreatment agents and the textile printing inks were changed to those shown in Table 2. The results are shown in Table 2.

TABLE 1

| | | Pretreatment | Water absorption | | Resistance to | Max. color depth | | Gradation | |
|---|---|---|---|---|---|---|---|---|---|
| | Cloth | Agent [conc. in aq. solution (%)] | (sec) | Ink | bleeding | 8 | 17 | 8/2 | 17/2 |
| Ex. 1 | Cotton | Water repellent 2 [3], $Na_2CO_3$ [2] | 10 | Reactive Y | A | A | A | A | A |
| Ex. 2 | Cotton | Water repellent 2 [3], $Na_2CO_3$ [2] | 10 | Reactive M | A | A | A | A | A |
| Ex. 3 | Cotton | Water repellent 3 [3], $Na_2CO_3$ [2] | 10 | Reactive C | A | A | A | A | A |
| Ex. 4 | Cotton | Water repellent 3 [3], $Na_2CO_3$ [2] | 10 | Reactive Bk | A | A | A | A | A |
| Ex. 5 | Cotton | Water repellent 1 [1], $Na_2CO_3$ [2] | 30 | Reactive Bk | A | A | A | A | A |
| Ex. 6 | Nylon | Water repellent 2 [3] | 15 | Acid Y | A | A | A | A | A |
| Ex. 7 | Nylon | Water repellent 2 [3] | 15 | Acid M | A | A | A | A | A |
| Ex. 8 | Nylon | Water repellent 4 [3] | 15 | Acid C | A | A | A | A | A |
| Ex. 9 | Nylon | Water repellent 4 [3] | 15 | Acid Bk | A | A | A | A | A |
| Ex. 10 | Nylon | Water repellent 1 [1] | 35 | Acid Bk | A | A | A | A | A |
| Ex. 11 | Polyester | Water repellent 1 [3] | 40 | Disperse Y | A | A | A | A | A |
| Ex. 12 | Polyester | Water repellent 1 [3] | 40 | Disperse M | A | A | A | A | A |
| Ex. 13 | Polyester | Water repellent 1 [3] | 40 | Disperse Bk | A | A | A | A | A |

Water repellent 1: Zebran F-1 (trade name, fluorine-containing type water repellent, product of Ipposha Oil Industries Co., Ltd.).

Water repellent 2: Paragium SS (trade name, paraffinic softening water repellent, product of Ohara Paragium Chemical Co., Ltd.).

Water repellent 3: New Zebran R260 (trade name, fluorine-containing type water repellent, product of Ipposha Oil Industries Co., Ltd.).

Water repellent 4: Paragium RC (trade name, ethyleneurea type softening water repellent, product of Ohara Paragium Chemical Co., Ltd.).

TABLE 2

| | | Pretreatment | Water absorption | | Resistance to | Max. color depth | | Gradation | |
|---|---|---|---|---|---|---|---|---|---|
| | Cloth | Agent [conc. in aq. solution (%)] | (sec) | Ink | bleeding | 8 | 17 | 8/2 | 17/2 |
| Comp. Ex. 1 | Cotton | $Na_2CO_3$ [2] | 1 | Reactive Y | C | C | C | C | C |
| Comp. Ex. 2 | Cotton | $Na_2CO_3$ [2] | 1 | Reactive M | C | C | C | C | C |
| Comp. Ex. 3 | Cotton | Water-soluble polymer 1 [1], $Na_2CO_3$ [2] | 1 | Reactive C | B | C | C | C | C |
| Comp. Ex. 4 | Cotton | Water-soluble polymer 1 [1], $Na_2CO_3$ [2] | 1 | Reactive Bk | B | C | C | C | C |

TABLE 2-continued

| | Cloth | Pretreatment Agent [conc. in aq. solution (%)] | Water absorption (sec) | Ink | Resistance to bleeding | Max. color depth 8 | Max. color depth 17 | Gradation 8/2 | Gradation 17/2 |
|---|---|---|---|---|---|---|---|---|---|
| Comp. Ex. 5 | Cotton | Surfactant 1 [1], $Na_2CO_3$ [2] | 1 | Reactive Y | C | C | C | C | C |
| Comp. Ex. 6 | Cotton | Surfactant 1 [1], $Na_2CO_3$ [2] | 1 | Reactive M | C | C | C | C | C |
| Comp. Ex. 7 | Cotton | Surfactant 2 [1], $Na_2CO_3$ [2] | 1 | Reactive C | C | C | C | C | C |
| Comp. Ex. 8 | Cotton | Surfactant 2 [1], $Na_2CO_3$ [2] | 1 | Reactive Bk | C | C | C | C | C |
| Comp. Ex. 9 | Nylon | Water-soluble polymer 1 [1], $Na_2CO_3$ [2] | 1 | Acid Y | B | C | C | C | C |
| Comp. Ex. 10 | Nylon | Water-soluble polymer 1 [1], $Na_2CO_3$ [2] | 1 | Acid M | B | C | C | C | C |
| Comp. Ex. 11 | Nylon | Surfactant 1 [1] | 1 | Acid C | C | C | C | C | C |
| Comp. Ex. 12 | Nylon | Surfactant 1 [1] | 1 | Acid Bk | C | C | C | C | C |
| Comp. Ex. 13 | Polyester | Surfactant 1 [1] | 2 | Disperse Y | C | C | C | C | C |
| Comp. Ex. 14 | Polyester | Surfactant 1 [1] | 2 | Disperse M | C | C | C | C | C |
| Comp. Ex. 15 | Polyester | Surfactant 1 [1] | 2 | Disperse Bk | C | C | C | C | C |

(Note to Table 2)
Water repellent 1: Zebran F-1 (trade name, fluorine-containing type water repellent, product of Ipposha Oil Industries Co., Ltd.).
Water repellent 2: Paragium SS (trade name, paraffinic softening water repellent, product of Ohara Paragium Chemical Co., Ltd.).
Water repellent 3: New Zebran R260 (trade name, fluorine-containing type water repellent, product of Ipposha Oil Industries Co., Ltd.).
Water repellent 4: Paragium RC (trade name, ethyleneurea type softening water repellent, product of Ohara Paragium Chemical Co., Ltd.).
Surfactant 1: Noigen HC (trade name, nonionic surfactant, product of Dai-ichi Kogyo Seiyaku Co., Ltd.).
Surfactant 2: Neocall SW (trade name, anionic surfactant, product of Dai-ichi Kogyo Seiyaku Co., Ltd.).
Water-soluble polymer 1: Carboxymethylcellulose.

As apparent from Tables 1 and 2, all the prints according to Examples 1 to 13 were free of bleeding, high in maximum color density and also excellent in gradation, whereas the prints according to Comparative Examples 1 to 15 were low in maximum color density and also poor in gradation because the K/S value by no means reached 15.

In the prints obtained in Examples 1 to 13, the shot-in ink quantities per unit area of the fabric at mixed-color areas (R=Y+M, G=Y+C, B=M+C) each amounted to twice that of the single-color area (Y, M or C). However, the inks remained by comparison on the surface of the fabric. Therefore, in each case, the print was excellent in coloring ability and resistance to bleeding. On the other hand, the prints according to the comparative examples were poor in coloring ability because the inks penetrated into the interior of the fibers.

As described above, the ink-jet printing processes according to the present invention permit the provision of bright prints free of bleeding, high in color depth, excellent in gradation and high in image quality.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink-jet printing method comprising the steps of:

(i) applying a water repellent to a cloth so that the cloth has a water absorption of at least 3 seconds as determined by a dropping method prescribed by JIS L-1096 A, and (ii) ejecting quantities of inks with an ink-jet printing apparatus to conduct printing on the cloth resulting from step (i), resulting in an ink quantity per unit of area of the cloth, wherein the ink quantity per unit of area of the cloth is changed to conduct gradation control, and the ink quantity for each of the inks when printing a maximum color density is adjusted within a range of from not less than 8.0 $\mu g/mm^2$ to not more than 35.0 $\mu g/mm^2$.

2. The ink-jet printing method according to claim 1, wherein the water repellent is selected from the group consisting of fluorine-containing compounds, paraffinic compounds, pyridinium salts, N-methylolalkylamides, alkylethyleneureas, oxazoline derivatives, silicone compounds, triazine compounds, polyamide amine type softening agent paraffins and zirconium compounds, and the water repellent is applied at the step of providing the cloth.

3. The ink-jet printing method according to claim 1, wherein the water repellent is applied to the cloth in step (i) in an amount of from 0.1 to 10% by weight based on a weight of the cloth in the standard state prescribed by JIS L-1096.

4. The ink-jet printing method according to claim 1, wherein the ink-jet printing apparatus comprises an electrothermal converter, which generates thermal energy causing film boiling of ink, as an energy-generating means for ejecting the inks.

5. An ink-jet printing process for forming a print on a cloth, the print having a gradational change in color density, comprising the steps of:

(i) providing a cloth having water absorption of from 3 to 200 seconds by applying a water repellent to the cloth, the water absorption being determined by a dropping method prescribed in JIS L-1096 A;

(ii) ejecting a quantity of an ink with an ink-jet printing apparatus to conduct printing on the cloth resulting from step (i), said printing resulting in an ink quantity per unit area of the cloth; and (iii) heating the cloth resulting from step (ii), and then washing the cloth, wherein step (ii) comprises a sub-step of changing the ink quantity per unit of area of the cloth in accordance with data for the print, and the ink quantity applied to a place on the cloth where maximum color density should be achieved ranges from 8.0 to 35.0 $\mu g/mm^2$.

6. A print obtained by the method according to any one of the preceding claims.

* * * * *

UNITED STATES PATENT AND TRADEMARK OFFICE

CERTIFICATE OF CORRECTION

PATENT NO. : 6,224,204 B1
DATED : May 1, 2001
INVENTOR(S) : Makoto Aoki

It is certified that error appears in the above-identified patent and that said Letters Patent is hereby corrected as shown below:

Title page,
Illustrative Figure, "QUANTIFY" should read -- QUANTITY --.

Drawings,
Sheet 4, Fig. 5, "QUANTIFY" should read -- QUANTITY --.

Column 1,
Line 19, "lower," should read -- lower; --.

Column 2,
Line 54, "is hard to absorb ink," should read -- does not absorb ink easily, --.
Line 56, "a blank" should read -- the blank --; and "a color" should read -- color --.
Line 62, "spread" should read -- spreading --; and "a" should read -- the --.

Column 3,
Line 47, "fiber." should read -- the fiber. --.
Line 53, "contained," should read -- contained; --.
Line 54, "contained," should read -- contained; and --.

Column 4,
Line 6, "is" should read -- the invention is --.
Line 20, "penetrate" should read -- penetrate into --.

Column 5,
Line 65, "is" should read -- are --.

Column 6,
Line 17, "thickness" should read -- thickness of --.

UNITED STATES PATENT AND TRADEMARK OFFICE

CERTIFICATE OF CORRECTION

PATENT NO. : 6,224,204 B1
DATED : May 1, 2001
INVENTOR(S) : Makoto Aoki

It is certified that error appears in the above-identified patent and that said Letters Patent is hereby corrected as shown below:

Column 12,
Line 8, "20" should read -- 20× --.

Column 16,
Line 12, "the preceding claims." should read -- claims 1-5 --.

Signed and Sealed this

Tenth Day of June, 2003

JAMES E. ROGAN
*Director of the United States Patent and Trademark Office*